United States Patent [19]

Ratzky

[11] Patent Number: 4,653,675

[45] Date of Patent: Mar. 31, 1987

[54] HAND-HELD MOTOR-DRIVEN EXTRUDING DEVICE FOR DISPENSING A PLASTIC SUBSTANCE

[75] Inventor: Reiner Ratzky, Neunkirchen, Fed. Rep. of Germany

[73] Assignee: Hilti Aktiengesellschaft

[21] Appl. No.: 769,158

[22] Filed: Aug. 23, 1985

[30] Foreign Application Priority Data

Aug. 25, 1984 [DE] Fed. Rep. of Germany ..... 3431291
Apr. 11, 1985 [DE] Fed. Rep. of Germany ..... 3512967

[51] Int. Cl.[4] ..... B67D 5/42
[52] U.S. Cl. ..... 222/390; 222/333
[58] Field of Search ..... 222/370, 386, 333, 326, 222/327; 24/424.5, 606 R

[56] References Cited

U.S. PATENT DOCUMENTS

| | | | |
|---|---|---|---|
| 2,019,660 | 4/1954 | Waltoff | 222/320 |
| 2,052,296 | 8/1936 | Huntley | 222/390 |
| 2,748,991 | 6/1956 | McCarthy | 222/390 |
| 3,082,914 | 3/1963 | Gill | 222/390 |
| 3,913,799 | 10/1975 | Davis, Jr. | 222/390 |
| 3,984,033 | 10/1976 | Groth et al. | 222/390 |

FOREIGN PATENT DOCUMENTS

| | | |
|---|---|---|
| 3428202 | 7/1978 | Fed. Rep. of Germany . |
| 2049299 | 3/1956 | France . |

*Primary Examiner*—Joseph J. Rolla
*Assistant Examiner*—Kenneth Noland
*Attorney, Agent, or Firm*—Toren, McGeady and Goldberg

[57] ABSTRACT

A hand-held motor driven extruding device for dispensing a plastic substance such as a sealing compound, a bonding agent and the like, utilizes a multi-part telescopic threaded spindle in place of a single piston rod. The threaded spindle includes a first spindle section fixed in the housing of the device. The first spindle section can be rotated in both directions around its axis, but is secured against displacement in the axial direction. At least one threaded spindle section can be extended and retracted relative to the first threaded section so that in the retracted condition the spindle sections are arranged one within the other. The piston is secured to the end of the spindle section spaced most remotely from the first spindle section in the extended condition and the piston is fixed against relative rotation with respect to the spindle section to which it is secured.

3 Claims, 2 Drawing Figures

HAND-HELD MOTOR-DRIVEN EXTRUDING DEVICE FOR DISPENSING A PLASTIC SUBSTANCE

BACKGROUND OF THE INVENTION

The present invention is directed to a hand-held motor-driven extruding device for dispensing plastic substances, such as sealing compounds, bonding agents, putty and the like with a container for the plastic substance and a piston movable back and forth along the length of the container. The motor drive is arranged in a drive housing equipped with a handle.

If the plastic substance is packaged in a cartridge with a diameter corresponding to that of the piston, then the cartridge can be inserted into a trough-shaped, semi-cylindrical holder when the piston is fully retracted. The invention can also be used with a cylindrical holder so that the plastic substance packaged in a foil sheath can be positioned within the holder forwardly of the retracted piston.

Since the operation of a hand-held extruding device can be very tiring and causes the operator to discontinue the extruding operation while some of the plastic substance remains in the cartridge, manually operated extruding devices using compressed air or an electromotor drive were developed. The compressed air-driven extruding devices require a compressor at the construction site and it is often difficult to accommodate a compressor, particularly when adhering roof coverings. Further, the required hoses frequently become fouled by the plastic substance being used and tend to become blocked resulting in a considerable amount of work in cleaning such devices.

Motor-driven hand operated extruding devices with a worm drive for the piston have the disadvantage that the piston rod extends out of the drive housing when the piston is retracted and the rod can easily be bent due to rough handling. If the piston rod becomes bent, the device can no longer be used. To avoid the use of power lines, it has been known to use manually operated extruding devices without cables which are powered by rechargeable batteries.

SUMMARY OF THE INVENTION

Therefore, the primary object of the present invention is to provide a motor-driven hand-held extruding device of the type described above, with the mechanism for extending and retracting the piston arranged within the drive housing even when the piston is fully retracted without extending the housing to correspond to the piston travel.

In accordance with the present invention, the drive for the piston includes at least one multi-part telescopic threaded spindle with a first threaded spindle section fixed against axial displacement within the drive housing. The first spindle section has a sufficient length that the remaining spindle sections of the device in the fully retracted position of the piston are telescoped one within the other. One threaded spindle section is connected to the piston so that there is no relative rotation between them and, further, the one threaded spindle section does not rotate along with the other spindle sections.

As a result, the usually rigid and single-part piston rod of the piston used in the past is replaced by a multi-part telescopic threaded spindle and by employing a reversible drive the piston can be moved between the fully extended and the fully retracted positions. In the retracted position of the piston, when a cartridge or foil sheath with a plastic substance is inserted into the holder, all of the threaded spindle sections are telescoped one inside the other and extend only for the length of the first threaded section of the threaded spindle which is rotatable but is fixed against axial displacement. Since a telescopic threaded spindle increases or decreases in length according to the drive direction, if one threaded spindle section is connected with the piston so that there is no relative rotation between them and it does not rotate with the other spindles, the invention involves securing the spindle section fixed to the piston against any rotation along the full axial travel of the piston. This feature is primarily essential if the piston is not under load when it is being retracted and could rotate along with the entire extended telescopic threaded spindle. There are different ways for securing the piston or the spindle section on which it is connected against relative rotation.

One embodiment is characterized by a telescopic-like guidance rod with a non-circular cross-section of the rod elements for preventing rotation of the piston and of the spindle section connected to the piston. The guidance rod surrounds a central telescopic threaded spindle and is attached at one end to the piston and at the other end to the drive housing and is arranged concentrically with the telescopic threaded spindle. In such an arrangement, the telescopic threaded spindle is positioned within the telescope-like guidance rod with the rod sections having a non-circular preferably four-sided cross-section. Since the first rod section is attached to the drive housing so that it does not rotate relative to the housing and since the last rod element is connected to the piston, the torque of the telescopic threaded spindle located within the rod sections and acting on the piston is absorbed by the positive lock of all of the noncircular rod sections. This embodiment has the additional advantage that the telescopic threaded spindle is protected against any contamination.

Another embodiment involving the basic concept of the invention involves providing more than one telescopic threaded spindle, telescopically driven and in eccentric engagement with the piston for preventing rotation of the piston and thus of the threaded spindle sections connected to it. Such an arrangement is expensive, since a certain amount of gearing is required in the drive housing, however, with this arrangement it is possible to drive at least one pair of telescopic threaded spindles in opposite directions so that the opposing torques developed in the piston cancel one another out.

In yet another embodiment of the basic invention, it is preferred to secure the threaded spindle section adjacent to the piston against rotation and involves forming this spindle section as a threaded sleeve with the largest diameter. An outwardly protruding pin is provided on the sleeve at its end spaced from the piston and the pin engages in an axially extending slot in an axially displaceable sleeve which, in turn, is fixed by a protruding pin in an axially extending slot of another sleeve fixed to the drive housing. As a result, it is guided at one end by the threaded spindle section connected to the piston and at the other end by the fixed sleeve. Accordingly, it is possible to guide an axially displaceable sleeve at one end on the spindle section adjacent the piston and to guide the other end of the sleeve on a fixed sleeve in a telescopic fashion with certain sleeves provided with axially extending slots so that the sleeves are not rotatable relative to one another or relative to the threaded sleeve of the telescopic spindle. This arrangement is effected by cams or pins engaging in the longitudinal slots.

Since the threaded spindle section closest to the drive has the smallest diameter, in accordance with the present invention, the spindle section closest to the drive is connected to a disc-like flange. A spur wheel concentric with the threaded spindle sections is attached to the flange and the flange is fixed against axial movement between a sleeve fixed to the drive housing and the rear part of the drive housing. The concentric arrangement of the spur wheel in the drive of the telescopic spindle made possible by the flange, reduces the space requirement for the gearing within the drive housing.

If a manually operated extruding device according to the present invention is equipped with a cylindrical holder for a plastic substance packed in a foil sheath, the drive housing with the telescopic spindle and piston is disengageably connected with the cylindrical holder, for instance, by means of a bayonet lock.

Accordingly, a sleeve attached to the drive housing and projecting outwardly from it is provided with a ring element at its end outwardly from the housing. The ring element is formed with an exterior thread for screwing on a sleeve-holder for the plastic substance. The sleeve secured to the housing along with the tranverse dimension of the housing receives the threaded spindle sections telescoped one within the other when the piston is in the fully retracted position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
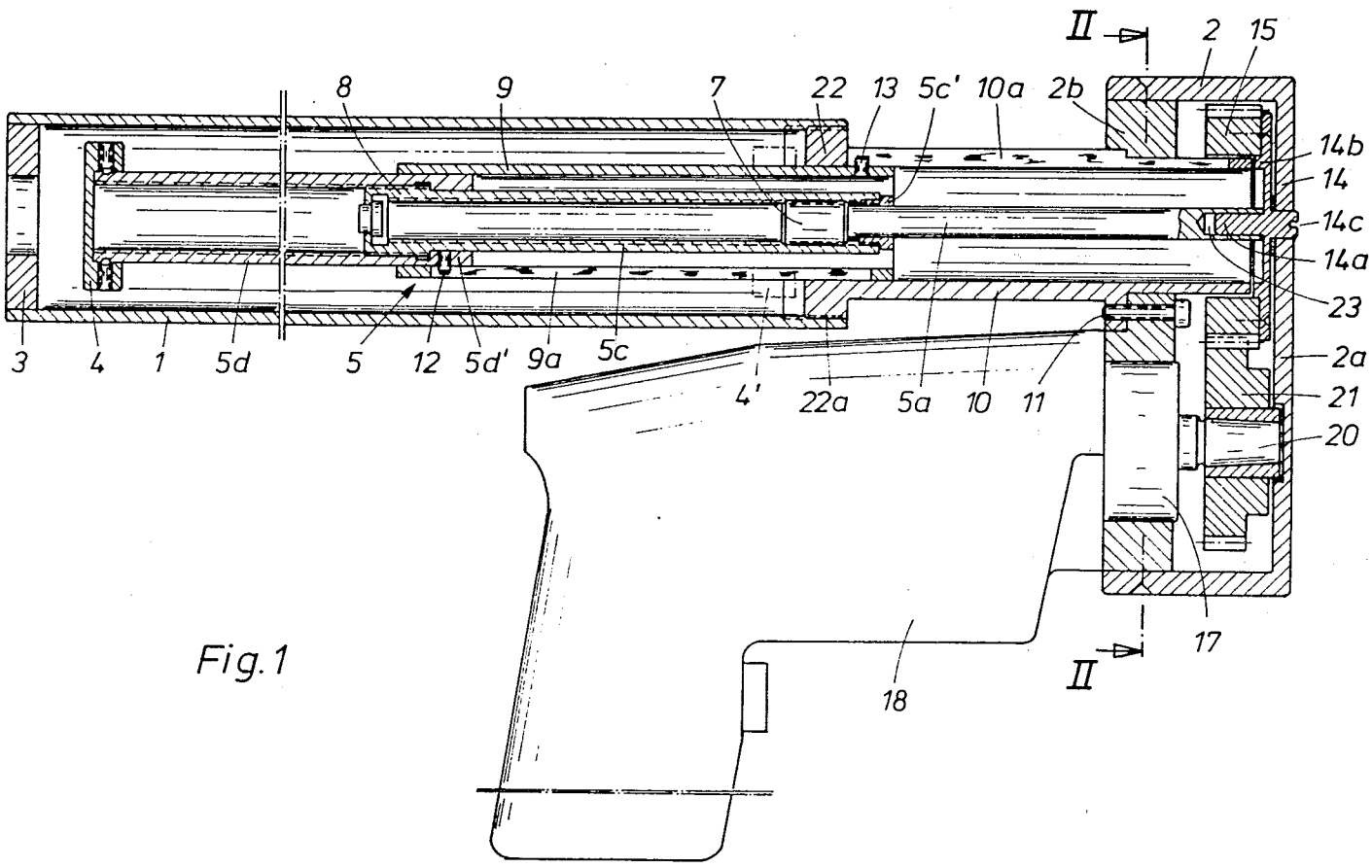
FIG. 1 is a side view, partly in axial section of a hand-held extruding device in the operating condition with the telescopic threaded spindle being fully extended.

As illustrated in FIG. 1, the hand-held extrusion device has a cylindrical holder 1 for receiving the plastic compound which is packed into a foil sheath and is removably attached to the drive housing 2. As viewed in FIG. 1, the left-hand end of the holder 1 is the front end and it is partially closed by a circular disc 3 for mounting an extrusion nozzle, not shown.

As displayed in FIG. 1, a piston 4 is located adjacent the disc 3 and is mounted on the front end of a multipart telescopic threaded spindle 5 illustrated in the extended position. The telescopic threaded spindle 5 includes a driven first threaded spindle section 5*a* fixed to the drive housing 2, as will be explained later. The first threaded spindle section 5*a* has an enlarged threaded head 7 at its end spaced outwardly from the end fixed to the drive housing. Threaded head 7 is engaged with the inside thread of a sleeve-like second threaded spindle section 5*c*. The end of the second spindle section 5*c* spaced axially from the threaded head 7, as shown in FIG. 1, has an increased diameter threaded head 8 which is engaged with the inside thread of the last or third sleeve-like threaded spindle section 5*d*. The third spindle section 5*d* has the largest diameter of the three spindle sections and the piston 4 is secured at its end spaced axially from the second spindle section 5*c* as depicted in FIG. 1. Each of the second and third spindle sections 5*c*, 5*d* have an inwardly projecting annular collar 5*c*', 5*d*' at the end of the section closer to the drive housing 2 and in the fully extended position the threaded head 7 contacts the collar 5*c*' and the threaded head 8 bears against the annular collar 5*d*' for limiting the extension of the telescopic spindle 5 and to enable rotational movement of the larger diameter threaded spindle section by abutment, as is known in principle with telescopic spindles.

The piston and the third threaded spindle section 5*d* are secured against rotation, particularly during retraction of the telescopic threaded spindle 5 (because the piston is not securely held due to frictional engagement with the plastic substance being extruded) and consists in laterally enclosing the telescopic threaded spindle 5 along a portion of its extended length by a pair of sleeves 9, 10 displaceable relative to one another in the axial direction. Sleeve 9 is axially displaceable and is guided at one end on the outer surface of the sleeve-like third spindle section 5*d* and at the opposite end on the inner surface of the sleeve 10. The sleeve 10 is fixed to the housing 2 by screws 11, note FIG. 2. Each of the sleeves 9, 10 has an axially extending slot 9*a*, 10*a*. A pin 12 attached to and extending outwardly from the annular collar 5*d*' engages in the slot 9*a* of the axially movable sleeve 9 and prevents the sleeve-like third spindle section 5*d* from rotating as long as the sleeve 9 does not rotate.

Rotation of the sleeve 9 is prevented by the engagement of an outwardly extending pin 13 at the rear end of the sleeve 9 closer to the drive housing with the pin 13 extending into the slot 10*a* of the fixed sleeve 10.

To drive the first threaded spindle section 5*a*, the section is fixed to a disc-like flange 14 within the drive housing and a spur wheel 15 is secured to the flange and laterally encircles the rear end of the sleeve 10. Accordingly, the spur wheel is arranged concentrically with the threaded spindle sections 5*a*, 5*c* and 5*d* in a space saving manner. At its center, the disc-like flange 14 has a post 14*a* extending into a blind bore 23 in the rear end of the threaded spindle section 5*a*. The post 14*a* is connected with the first threaded spindle section 5*a* so that there is no relative rotation between them nor is there any axial displacement between them. These parts are not shown in detail. The post 14*a* can be bonded, pressed or welded into the blind bore 23. Since the disc-shaped flange 14 is supported on one side by the housing wall 2*a* and on the opposite side by an axially extending circular projection 14*b* against the rear end of the sleeve 10, the first threaded spindle section 5*a* is secured against any axial displacement. The portion of the post 14*a* protruding rearwardly through the housing wall 2*a* has a transverse slot 14*c* arranged to receive a screw driver so that the telescopic threaded spindle 5 can be turned manually, for instance to eliminate a jammed condition.

Figure 2:
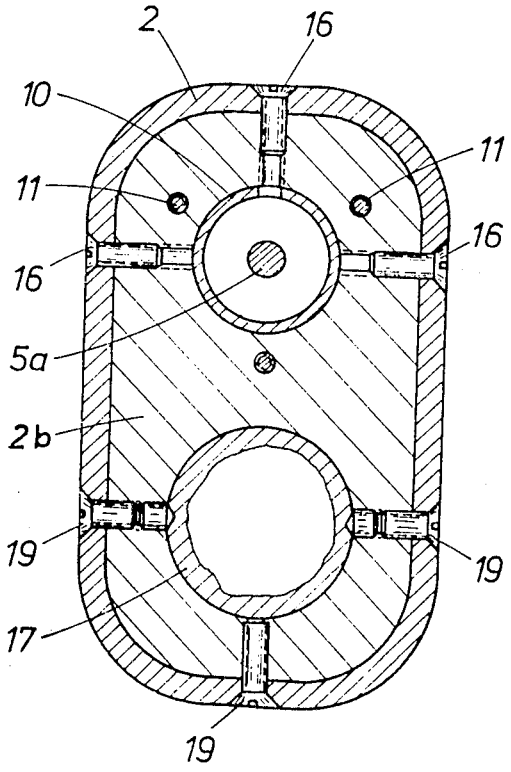
FIG. 2 is a sectional view taken along the line II—II in FIG. 1.

As illustrated in FIGS. 1 and 2, the housing 2 is can-shaped and is closed on its front end by an annular disc 2*b* fixed in place by the screws 16. A support housing 17 for a handle 18 is positioned in the portion of the disc 2b located below the threaded spindle 5 and the housing 17 is held in place by three screws 19. A drive shaft 20 extends out of the support housing 17 and is driven by an electric motor, not shown, located inside the handle 18. Handle 18 can also enclose a rechargeable battery for powering the electromotor with current. A spur wheel 21 is mounted on the drive shaft 20 so that it is rotated by drive shaft and is in meshed engagement with the spur wheel 15 for rotating the first threaded spindle section 5a.

The sleeve 10 fixed at its rear end to the housing 2 is provided at its opposite end with a ring part 22. The radially outer surface of the ring part 22 is threaded, preferably with a bayonet thread 22a so that the sleeve-like holder 1 for the plastic substance can be connected to the drive housing 2, since the fixed sleeve 10 forms an integral part of the drive housing 2, 2b and because of its larger diameter is capable of receiving the threaded spindle sections telescoped one within the other when the piston is in the fully retracted position 4' shown in dot-dash lines in FIG. 1.

While specific embodiments of the invention have been shown and described in detail to illustrate the application of the inventive principles, it will be understood that the invention may be embodied otherwise without departing from such principles.

I claim:

1. Hand-held motor-driven extruding device for dispensing plastic substances, such as sealing compounds, bonding agents, putty and the like, comprising a housing including a handle arranged to receive a motor drive, an axially elongated container for the substance to be dispensed, and means mounted on said housing and including a piston arranged to be moved by the motor drive reciprocably through and in the axially elongated direction of said container for dispensing the plastic substance out of said container, wherein the improvement comprises that said means includes at least one multi-part telescopic threaded spindle, said threaded spindle comprises an axially elongated first threaded spindle section fixed to said housing against displacement in the axially elongated direction of said container, and at least one second threaded spindle section telescopically movable relative to said first threaded spindle section in the axial direction of said first threaded spindle section, said first threaded spindle section has an axial length so that said at least one second threaded spindle section and said first threaded spindle section can be moved between a fully extended position and a fully retracted position whereby in the fully retracted position said first and second threaded spindle sections are located one inside the other, said piston is mounted on the end of said at least one second threaded spindle section more remote from the location where said first threaded spindle section is fixed to said housing, and said at least one second threaded spindle section is connected with said piston so that there is no relative rotation therebetween over the full axial travel of said piston between the fully retracted position and the fully extended position, said at least one second threaded spindle section includes at least two said second threaded spindle sections with one of said second threaded spindle sections being attached to said piston and the other said second threaded spindle section extending between the one said second threaded spindle section and said first threaded spindle section in the extended condition, the one of said second threaded spindle section being a sleeve-like member and said sleeve-like member having a diameter larger than that of the other said second threaded spindle section and said first threaded spindle section, said sleeve-like member having a first end at which said piston is located and an opposite second end, a generally radially outwardly projecting pin located at the second end of said sleeve-like member, an axially displaceable sleeve located radially outwardly from the other said second threaded spindle section in the extended condition and said sleeve having an axially extending slot therethrough, said pin on the second end of said sleeve-like member extends into said slot in said sleeve, a fixed sleeve secured to said housing and having a larger diameter than said axially displaceable sleeve so that said axially displaceable sleeve can fit within said fixed sleeve in the retracted condition of said device, a radially outwardly projecting pin formed on the end of said axially displaceable sleeve closer to said housing in the extended condition, said fixed sleeve having an axially extending slot therein, said pin on said axially displaceable sleeve extending into said slot in said fixed sleeve whereby in the extended condition one end of said axially displaceable sleeve is guided within said fixed sleeve and the other end of said axially displaceable sleeve is guided on said sleeve-like member forming the one said second threaded spindle.

2. Hand-held motor-driven extruding device; as set forth in claim 1, wherein said first threaded spindle section has a first end and a second end, a disc-like flange secured to the first end of said first said spindle section and extending transversely thereof and outwardly from said first threaded spindle section, a spur wheel connected to said disc-like flange and disposed concentrically with said first and second threaded spindle sections and located outwardly from the outer surface of said fixed sleeve, said fixed sleeve having an end adjacent said flange and said flange is fixed in the axial direction of said telescopic threaded spindle between said fixed sleeve and said housing.

3. Hand-held motor-driven extruding device for dispensing plastic substances, such as sealing compounds, bonding agents, putty and the like, comprising a housing including a handle arranged to receive a motor drive, an axially elongated container for the substance to be dispensed, and means mounted on said housing and including a piston arranged to be moved by the motor drive reciprocably through and in the axially elongated direction of said container for dispensing the plastic substance out of said container, wherein the improvement comprises that said means includes at least one mult-part telescopic threaded spindle, said threaded spindle comprises an axially elongated first threaded spindle section fixed to said housing against displacement in the axially elongated direction of said container, and at least one second threaded spindle section telescopically movable relative to said first threaded spindle section in the axial direction of said first threaded spindle section, said first threaded spindle section has an axial length so that said at least one second threaded spindle section and said first threaded spindle section can be moved between a fully extended position and a fully retracted position whereby in the fully retracted position said first and second threaded spindle sections are located one inside the other, said piston is mounted on the end of said at least one second threaded spindle section more remote from the location where said first threaded spindle section is fixed to said housing, and said at least one second threaded spindle section is connected with said piston so that there is no relative rotation therebetween over the full axial travel of said piston between the fully retracted position and the fully extended position, said container comprises a cylindrically shaped holder arranged to receive the plastic substance packaged in a foil sheath, said holder is detachably connected with said drive housing, a fixed sleeve is secured at one end to said drive housing and has a ring portion at the other end, said ring portion extends around and radially outwardly from said fixed sleeve, the radially outer surface of said ring portion is threaded for receiving a threaded end of said holder for the plastic substance.

* * * * *